US005230469A

United States Patent [19]

Fisher

[11] Patent Number: 5,230,469

[45] Date of Patent: Jul. 27, 1993

[54] BOLTED RAIL FASTENING SYSTEM FOR JOINT BAR LOCATION

[76] Inventor: George K. Fisher, 1616 Bellevue Blvd. North, Bellevue, Nebr. 68005

[21] Appl. No.: 908,054

[22] Filed: Jul. 6, 1992

[51] Int. Cl.[5] ..... E01B 9/46

[52] U.S. Cl. ..... 238/210; 238/217; 238/342; 238/344; 238/347

[58] Field of Search ..... 238/156, 160, 187, 191, 238/209, 210, 215, 217, 297, 306, 338, 342, 343, 344, 345, 347

[56] References Cited

U.S. PATENT DOCUMENTS

| | | | |
|---|---|---|---|
| 381,238 | 4/1888 | Harrington et al. | 238/338 X |
| 803,429 | 10/1905 | Post | 238/210 X |
| 880,381 | 2/1908 | Hindman | 238/209 |
| 1,185,549 | 5/1916 | Smith | 238/210 |
| 1,863,276 | 6/1932 | McGrew | 238/210 |
| 2,024,870 | 12/1935 | Oberg | 238/304 |
| 2,083,952 | 6/1937 | Haswell | 238/306 |
| 3,147,921 | 9/1964 | Delcroix | 238/310 |
| 3,352,491 | 11/1967 | Nelson | 238/209 |
| 3,658,245 | 4/1972 | Nelson | 238/187 X |
| 4,062,490 | 12/1977 | Hixson | 238/338 |
| 4,193,544 | 3/1980 | Marchant et al. | 238/347 |
| 5,123,596 | 6/1992 | Fisher et al. | 238/342 |

FOREIGN PATENT DOCUMENTS

| | | | |
|---|---|---|---|
| 551521 | 6/1932 | Fed. Rep. of Germany | 238/187 |
| 24513 | 8/1901 | Switzerland | 238/217 |

*Primary Examiner*—Frank E. Werner
*Assistant Examiner*—Scott L. Lowe
*Attorney, Agent, or Firm*—John A. Beehner

[57] ABSTRACT

A bolted rail fastening system for joint bar locations includes a rail mounted in a recessed area of a tie plate with the tie plate being secured to a cross-tie by means of coach screws extending downwardly therethrough. The rail is maintained in the recessed area by a pair of clips positioned at each side of the rail which each engage an upper surface of a joint bar, one joint bar positioned on each side of the rail. Rail connections may thus be secured to the cross-tie there underneath.

4 Claims, 5 Drawing Sheets

BOLTED RAIL FASTENING SYSTEM FOR JOINT BAR LOCATION

BACKGROUND OF THE INVENTION

1. Technical Field

This invention relates to a bolted rail fastening system and more particularly to a bolted rail fastening system for joint bar locations which will secure a rail to a tie plate along the length of rail to which joint bars are secured.

2. Description of the Prior Art

Historically, rails have been secured to wooden cross-ties by positioning the rail on a tie plate with the tie plate being secured to the cross-tie by means of spikes extending downwardly therethrough. The rail is normally secured to the tie plate itself by spikes extending downwardly through the tie plate into the cross-tie with the heads of the spikes being positioned above the base flange of the rail.

Many different types of systems have been previously devised to secure a rail to a tie plate without the use of such spikes. One such example is found in Fisher, U.S. Pat. No. 5,123,596, issued Jun. 23, 1992, which discloses a bolted rail fastening system comprising a rail mounted in a recessed area of a tie plate with the tie plate being secured to a cross-tie by means of coach screws extending downwardly therethrough. The rail is maintained in the recessed area by a pair of clips positioned at each side of the rail which will remain in position even if the nuts associated therewith become loose. Fisher, however, does not address the problem encountered in fastening a rail to a tie plate in the area of a joint bar, as the clips provided in Fisher are not of sufficient height or proper dimension to engage the joint bar location.

Harrington, U.S. Pat. No. 381,238, issued in 1888, shows a somewhat hybrid joint bar in FIG. 1 of that patent, which includes a lateral extension which is bolted to the tie plate. However, no separate joint bar clip is disclosed.

There is therefore a need for a bolted rail fastening system which may be used to secure rails in the area of joint bars.

Therefore it is a primary object of the present invention to provide an improved bolted rail fastening system for joint bar locations.

Another object of the present invention is to provide a bolted rail fastening system for joint bar locations which will ensure that the rail will be restrained laterally on the tie plate even though the fastening system therebetween becomes loose during use.

Still another object of the present invention is to provide a bolted rail fastening system for joint bar locations which includes a novel clip which will engage the joint bar, thus securing the joint bar location in place.

Still another object of the present invention is to provide a bolted rail fastening system for joint bar locations which facilitates the replacement of worn rails without the need for removing spikes and replacing the same, thereby increasing the life of the cross-tie.

Finally, an object of the present invention is to provide a bolted rail fastening system for joint bar locations which is simple to manufacture, safe in use and durable in construction.

SUMMARY OF THE INVENTION

A bolted rail fastening system for joint bar locations is described for mounting a rail on a cross-tie in the area of joint bar fasteners on a rail through the use of a tie plate and a pair of clip assemblies mounted at opposite sides of the rail. At each side of the tie plate, a first rectangular-shaped opening is formed therein which extends downwardly therethrough. A horizontally extending slot communicates with the lower end of the first rectangular-shaped opening and extends towards the rail. A second opening communicates with the slot and extends upwardly through the tie plate. The T-shaped head of a clip bolt is inserted downwardly into the first rectangular-shaped opening and then moved inwardly in the horizontally disposed slot so that the shank of the clip bolt extends upwardly through the second opening. A clip is mounted on the upper end of the clip bolt and has an inner end portion which engages the base flange of the joint bar and an outer end portion which engages the tie plate adjacent the first rectangular-shaped opening. A tooth protrudes from the lower end of the outer end of the clip and is received in the first rectangular-shaped opening. A nut is secured to the upper end of the clip bolt to maintain the clip in position. When the clip is so positioned, the tooth is positioned laterally of the T-shaped head portion of the clip bolt to prevent the clip bolt from rotating in the slot or moving laterally out of the slot. Even if the nut on the clip bolt should become loose or disengaged from the clip bolt, the clip remains on the upstanding clip bolt and provides lateral restraint to the joint bar on the rail on the tie plate. The tie plate is secured to the cross-tie by any convenient means such as coach screws extending downwardly through the tie plate into the cross-tie.

DESCRIPTION OF THE PREFERRED EMBODIMENTS

Figure 3:
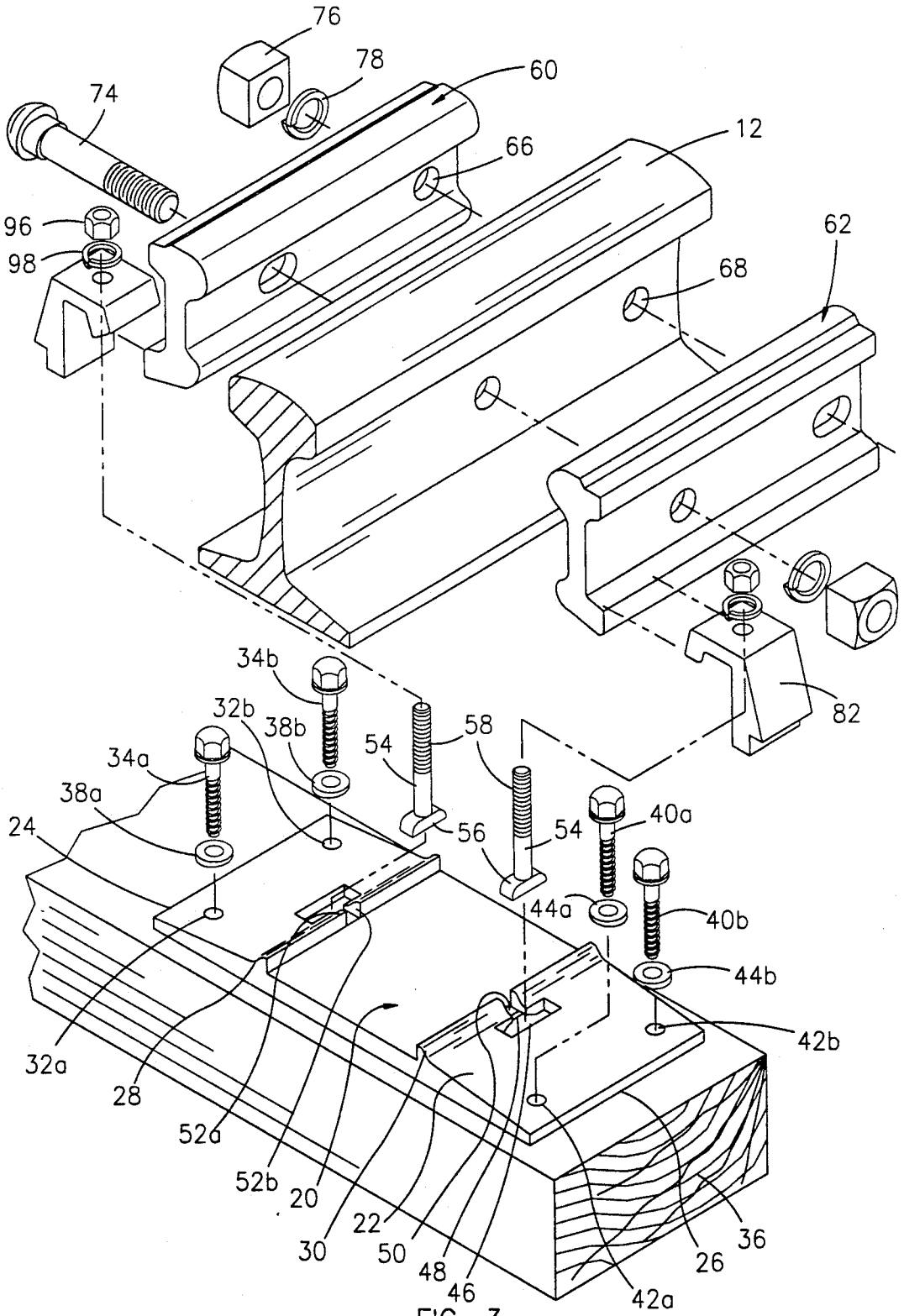
FIG. 3 is an exploded perspective view of the fastening system of FIG. 2.
Figure 4:
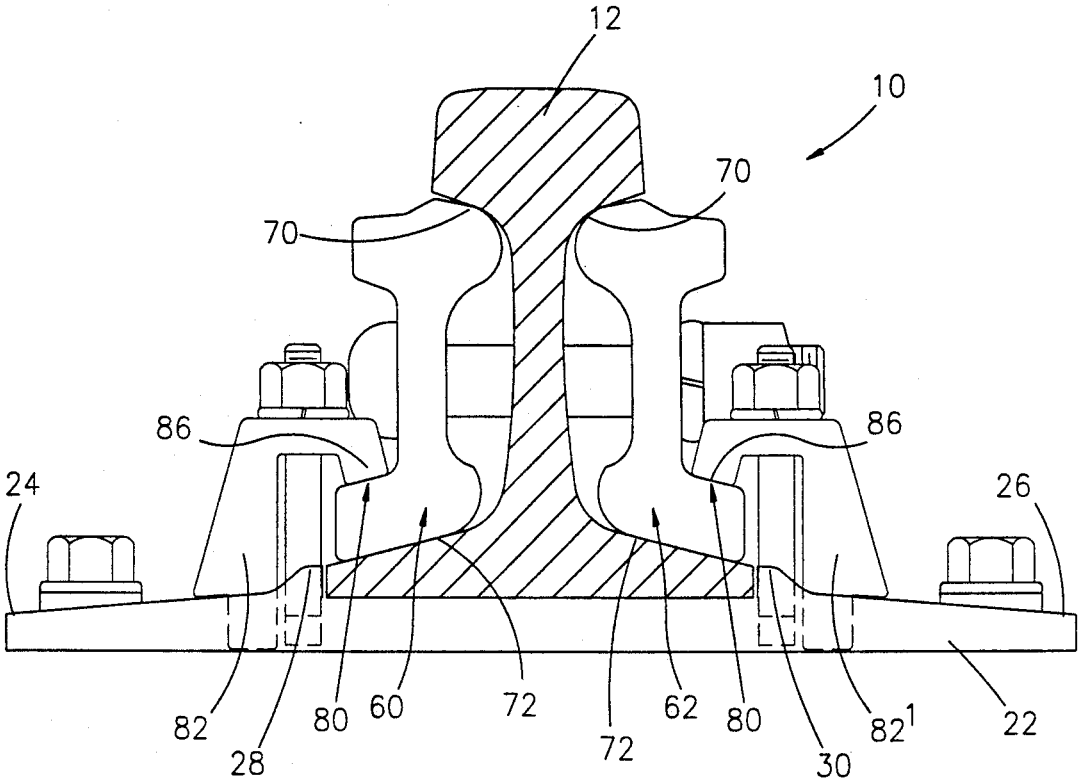
FIG. 4 is an enlarged sectional view of the fastening system of FIG. 2.

The bolted rail fastening system for joint bar locations 1*c* is shown in its preferred embodiment in FIGS. 1–4 as including a conventional railroad rail 12 having a base flange 14. The base flange 14 includes a left flange portion 16 and a right flange portion 18. Rail 12 is designed to be positioned in a recessed area 20 of tie plate 22. Recessed area 20 may be horizontally disposed but may also be inclined at a 1–30 slope if so desired. In some tie plate configurations, the recessed areas are omitted. For purposes of description, tie plate 22 includes a gauge end 24 and a field end 26. As seen in FIG. 4, recessed area 20 is defined by a pair of shoulders 28 and 30.

Tie plate 22 is provided with a pair of openings 32*a* and 32*b* formed therein adapted to receive threaded coach screws 34*a* and 34*b* extending downwardly therethrough respectively which are received in the cross-tie 36. Preferably washers 38*a* and 38*b* are utilized on the coach screws 34*a* and 34*b* respectively. Similarly, a pair of coach screws 40*a* and 40*b* extend downwardly through openings 42*a* and 42*b* in tie plate 22 adjacent field end 26 to be received by the cross-tie 36. As above, washers 44*a* and 44*b* are utilized on the coach screws 40*a* and 40*b* respectively. Normally, the cross-tie 36 will be pre-drilled to receive the coach screws 34*a*, 34*b*, 40*a* and 40*b*.

A first rectangular-shaped opening 46 is formed in tie plate 22 between shoulder 28 and gauge end 24. Slot 48 communicates with the lower end of opening 46 and extends toward the recessed area 20 beneath the upper surface of the tie plate 22. A second opening 50 is also formed in the tie plate 22 which communicates with slot 48 so as to define shoulders 52*a* and 52*b* therebetween.

Clip bolt 54 has a T-shaped head portion 56 and a threaded shank portion 58. Clip bolt 54 is secured to tie plate 22 by inserting the head portion 56 downwardly through the opening 46 and then moving the bolt 54 towards recessed area 20 so that the T-shaped head portion 56 is received in the slot 48 beneath the shoulders 52*a* and 52*b*. As seen in the drawings, the T-shaped head portion 56 is arcuate so as to be complimentary to the arcuate shoulders 52*a* and 52*b* to permit bolt 54 to pivot somewhat in the slot 48. Although FIG. 3 illustrates the shoulders 52*a* and 52*b* to be arcuate, the shoulders could be horizontally disposed if so desired, although the arcuate-shaped shoulders 52*a* and 52*b* are the preferred configuration.

Figure 1:
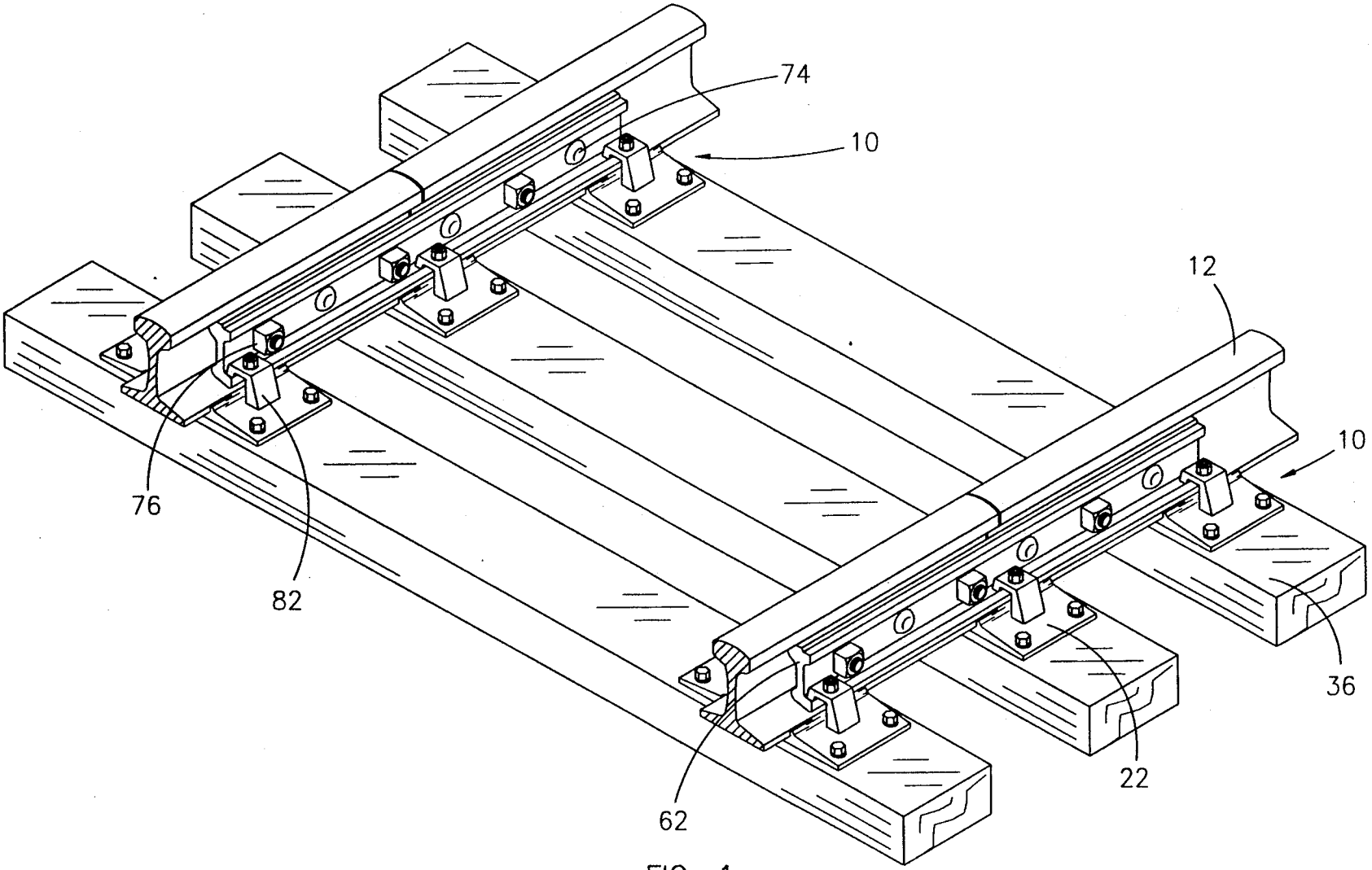
FIG. 1 is a perspective view of the fastening system installed at a joint bar location.
Figure 2:
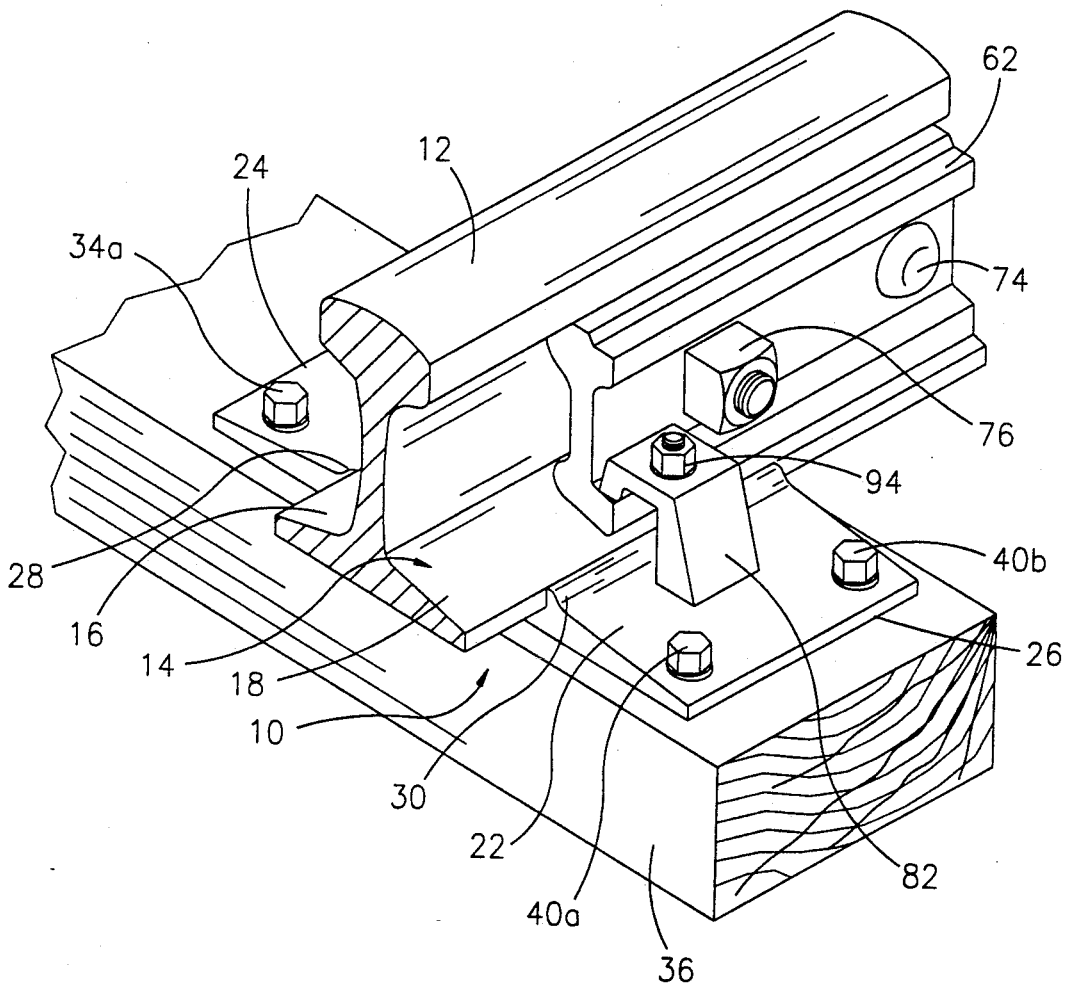
FIG. 2 is an enlarged detailed perspective view of one fastening system.

The present invention is designed to be used in the area where two rails are joined together by joint bars. FIGS. 1 and 3 provide the clearest depiction of joint bar position. FIG. 1 shows that the joint bars 60 and 62 are used in pairs to join two rail sections to one another, one joint bar positioned on each side of the rail 12. This is shown best in FIG. 3, which shows that the joint bars 60 and 62 have openings 66 therein which communicate with openings 68 formed in a rail section 12. Each joint bar 60 and 62 is preferably an irregular I-shape, each having an upper concave surface 70 and a lower angled surface 72. When positioned adjacent a rail side, the upper concave surface 70 of a joint bar engages the underside of the upper section of the rail 12, and the lower angled surface 72 engages the rail flange 14. The left and right joint bars 60 and 62 engage the respective surfaces in substantially the same manner. To secure the left and right joint bar 60 and 62 to the rail section 12, a plurality of bolts 74, nuts 76 and washers 78 are provided which extend through the openings 66 in the joint bars 60 and 62 and the openings 68 in the rail 12. The bolts 74 are preferably extended through the openings 66 in the joint bars 60 and 62 and the Openings 68 in the rail 12 in alternating directions, i.e., adjacent bolts extend in opposite directions. Furthermore, the majority of joint bar openings 66 formed in standard joint bars are spaced approximately 6" apart. Thus the left and right joint bars 60 and 62 may be secured to the rail section 12 and likewise rail section 12 to another rail section adjacent thereto in end-to-end configuration.

Figure 5:
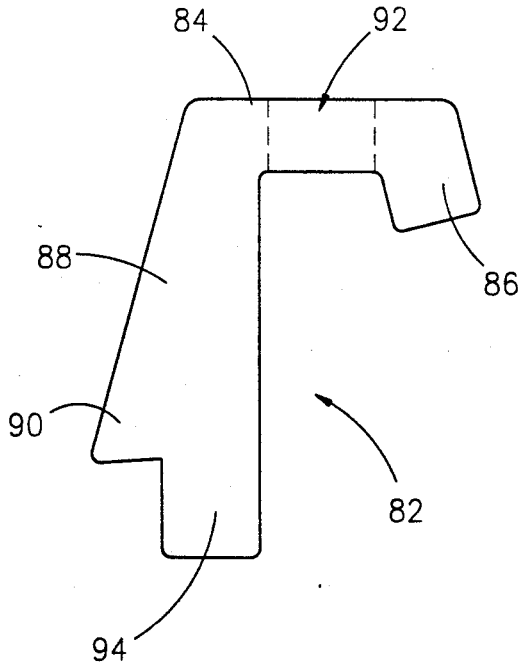
FIG. 5 is a side elevational view of the joint bar clip.
Figure 6:
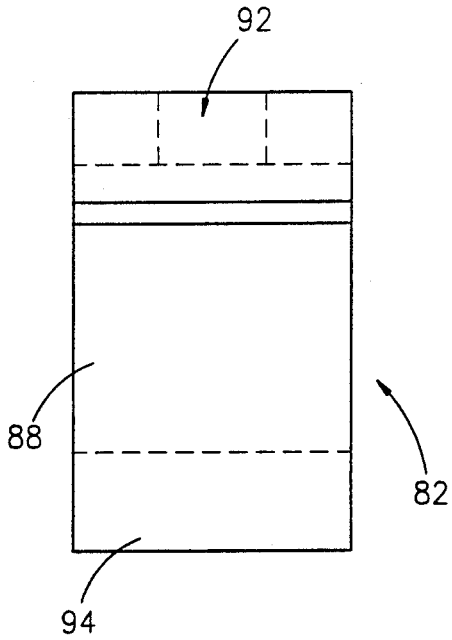
FIG. 6 is a front elevational view of the joint bar clip.

Furthermore, each of the joint bars 60 and 62 has an upper surface 80 substantially parallel to the lowered angled surface 72 and essentially comprising the top surface of the lower section of the irregular I-shape of the joint bar 60 and 62. Rail securement clip 82 is mounted on clip bolt 54 and includes an upper end portion 84 having an end portion 86 which extends downwardly therefrom for engagement with the upper surface so of one of the joint bars 60 and 62. Rail securement clip 82 also includes an end portion 22 which extends downwardly from upper end portion 84. End portion 88 extends rearwardly at an angle, as shown in FIG. 5 to be wider than rectangular-shaped opening 46. The thus formed heel portion 90 engages the tie plate 22 at the outer side of the rectangular-shaped opening 46 (see FIG. 4). Upper end portion 84 is provided with an opening 92 formed therein to permit the threaded shank portion 58 of bolt 54 to extend upwardly therethrough. Tooth 94 extends downwardly from the lower end of end portion 88. Tooth 94 has a length substantially equal to the length of the rectangular-shaped opening 46 to permit tooth 94 to be received therein. Tooth 94, when in position, prevents rotation of bolt 54 so that nut 96 may be tightened without the need for a wrench to be used on a lower end of bolt 54. Preferably, a washer 98 is included on bolt 54 and placed between the upper end portion 84 of the rail securement clip 82 and the nut 96. Therefore, when clip 82 is positioned on the bolt 54 and the tooth 94 is in the rectangular-shaped opening 46, the lower end of the tooth 94 is positioned laterally of the T-shaped head portion 56 of the bolt 54 to maintain bolt 54 in position. Washer 98 and nut 96 are mounted on the upper end of bolt 54 to maintain clip 82 in position.

End portion 88 of the rail securement clip 82 is preferably of substantial height to allow the end portion 86 to engage the upper surface 80 of a joint bar. If end portion 88 is not of sufficient height to allow end portion 86 to engage the upper surface 80, the bolted rail fastening system for joint bar locations 10 will not function as desired. Therefore, it is imperative that the rail securement clip 82 be of sufficient height to accommodate engagement of the upper surface 80 so of a joint bar. It is thus self-evident that rail securement systems designed to engage the flange of the rail itself will not function to secure a rail in a joint bar location. Moreover, the clip 82 must be narrow enough to fit between the bolts 74 and nuts 76 which connect the joint bars 60 and 62 to the rail 12. Therefore, other securement clips which are wider will not function to secure the rail in the area of a joint bar.

As shown in FIG. 4, a pair of rail securement clips 82 and 82', are used at a joint bar location to secure the railroad rail 12 to the tie plate 22. As shown in FIG. 1, one embodiment of the bolted rail fastening system for joint bar locations 10 would use a plurality of rail securement clips 82 positioned on a plurality of cross-ties 36 to secure a pair of railroad rails 12 to the respective tie plates 22 and cross-ties 36.

Figure 7:
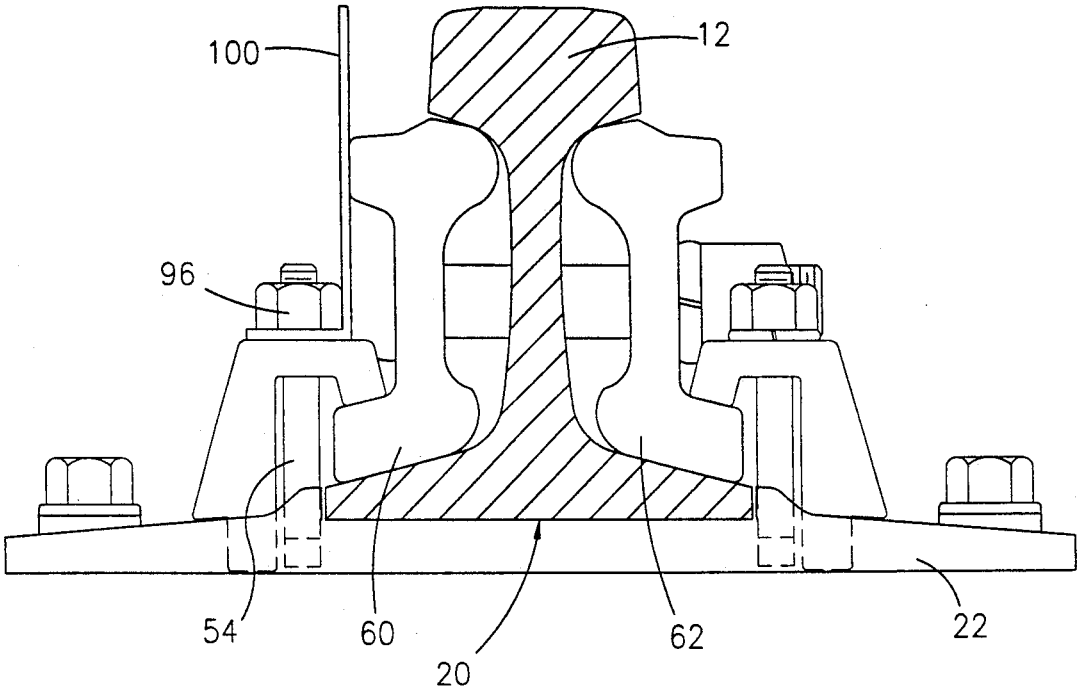
FIG. 7 is a sectional view of a bolted rail fastening system including an L-shaped wheel flange channel forming barrier plate.
Figure 8:
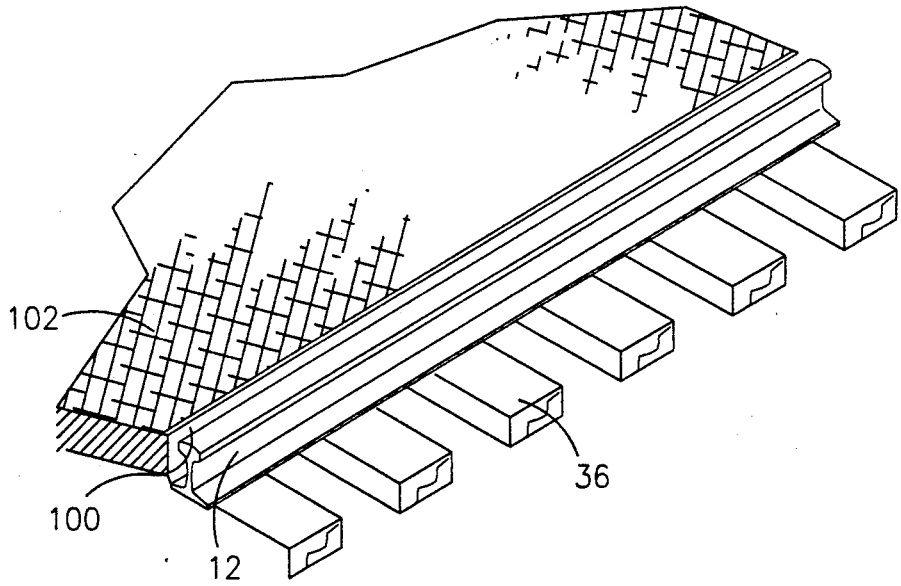
FIG. 8 is a perspective view illustrating asphalt laid up to and against the wheel flange channel forming barrier plate.

The method of installing the bolted rail fastening system for joint bar locations and its operation is as follows: tie plate 22 is installed on the cross-tie 36 by means of the coach screws 34*a*, 34*b*, 40*a* and 40*b* as previously described. Rail 12 is then positioned in the recessed area 20 as seen in the drawings. The T-shaped head portion 56 of bolt 54 is then extended downwardly through the rectangular-shaped opening 46 and then laterally into the slot 48 as previously described with the clip 82 then being installed on the bolt 54 as also previously described. When the nut 96 is tightened on the bolt 34, end portion 86 of rail securement clip 82 engages the upper surface 80 of joint bar 60, thus positively maintaining the rail 12 on the tie plate 22. If nut 96 becomes loose over a period of time, bolt 54 will be maintained in position as tooth 94 prevents bolt 54 from moving laterally in the slot 48 or rotating in the slot 48. If the nut 96 becomes excessively loose or becomes completely disengaged from the bolt 54, the clip 82 will remain on the bolt 54 due to the forces of gravity and will still have its outer end portion 86 positioned over the upper surface of joint bar 60 to provide lateral restraint for the rail 12 so that rail 12 remains in position on the tie plate 22. Clip 82' is installed as previously described and functions in an identical fashion to clip 82. FIG. 7 exhibits the system of FIG. 4 also including an L-shaped wheel flange channel-forming barrier plate 100 which should be used where an automobile road crosses the train tracks. The barrier plate 100 is mounted on the clip bolt 54 and is secured in place by the nut 96. FIG. 8 exhibits the use of the barrier plate 100 as asphalt 102 or other such paving material is laid up to and in contact with the barrier plate 100, which allows trains riding the rail 12 to be unimpeded. This invention is designed specifically to solve two long-felt but unsolved needs in the art of railroads; one, joint bar locations are not presently secured to cross-ties, but rather may shift vertically, and two, signalized track which has insulated joint bars cannot presently be secured to cross-ties and thus these joints are prone to vertical shifting.

As to the first problem, joint bar locations are presently only laterally secured by spikes inserted adjacent each rail. Spikes cannot secure the joint bar as not enough spike extends down into the cross-tie to secure the spike in place. Therefore, joint bar locations may shift vertically, placing stress on the rail sections. The present invention allows joint bar locations to be secured to a cross-tie, thus extending the life of a rail section and increasing the safety of the persons traveling thereover.

As to the second problem, insulated joint bars connect rail sections to allow rail operators to keep track of the location of trains by electrical impulses. Thus, a tie plate cannot be positioned at the joint between the rail sections; otherwise, the rails will be short-circuited. Therefore, a means must be provided to secure rails in the area of insulated joint bars and such is provided by utilizing the present invention with a pair of tie plates positioned adjacent a joint with clips securing the joint bars at those positions, thus addressing a long-felt need.

The present invention thus provides a method for securing a railroad rail to a cross-tie in the area of a joint bar, which previously presented several difficult problems.

There has thus been shown and described an invention which accomplishes at least all of the stated objectives.

I claim:

1. A bolted rail fastening system for joint bar locations for mounting a rail, having a base flange, and at least one joint bar for connecting rail sections, having a base flange, on a supporting elongated cross-tie, comprising:

a tie plate having an upper surface, and a bottom surface positioned on the cross-tie;

said tie plate having a central recessed area formed in upper surface thereof for receiving the base flange of a rail therein;

said recessed area being defined by a longitudinally extending first pair of shoulders on said tie plate, said tie plate having a gauge side positioned inwardly of said recessed area and a field side positioned outwardly of said recessed area;

said gauge-side and field-side tie plate shoulders each having an arcuate upper surface, forming a reversing fillet;

said tie plate having at least one opening formed therein adjacent each of the gauge and field sides thereof for receiving a fastening means extending downwardly therethrough into the cross-tie to secure said tie plate to the cross-tie;

said tie plate having a first generally rectangular-shaped opening formed therein extending downwardly therethrough between said recessed area and said gauge side, said first rectangular-shaped opening having its longitudinal axis parallel to the longitudinal axis of the rail;

said tie plate having a first slot formed beneath its upper surface which communicates with the lower portion of said first rectangular-shaped opening and which extends therefrom toward said recessed area;

said tie plate having a second opening formed therein extending downwardly therethrough, from the upper surface thereof, adjacent said recessed area which communicates with said first slot to define a second pair of shoulders therebetween;

a first clip bolt having a generally T-shaped head positioned in said first slot and a shank portion extending upwardly through said second opening, said T-shaped head being prevented from upward vertical movement by said second pair of shoulders, a first clip positioned on said first clip bolt and comprising an upper end portion having inner and outer ends, an outer end portion extending downwardly from the outer end of said upper end portion for engagement with the base flange of an adjacent joint bar, an inner end portion extending downwardly from the inner end of said upper end portion, and a tooth means extending downwardly from the lower end of said inner end portion of said first clip into said first rectangular-shaped opening, said tooth means having a length substantially equal to the length of said first rectangular-shaped opening, said inner end portion having a width greater than said first rectangular-shaped opening to form a first heel portion in engagement with said tie plate rearward of said first rectangular-shaped opening;

said tooth means being positioned inwardly of said T-shaped head portion of said first clip bolt to maintain said T-shaped head portion of said first clip bolt in said first slot and said shank portion in said second opening;

a nut means on the upper end of said first clip bolt for maintaining said first clip thereon;

said tie plate having a second generally rectangular-shaped opening extending downwardly therethrough between said recessed area and said field side, said second rectangular-shaped opening having its longitudinal axis parallel to the longitudinal axis of the rail;

said tie plate having a second slot formed beneath its upper surface which communicates with the lower portion of said second rectangular-shaped opening and which extends therefrom towards said recessed area;

said tie plate having a third opening formed therein extending downwardly therethrough, from the upper surface thereof which communicates with said second slot, to define a third pair of shoulders therebetween;

a second clip bolt having a generally T-shaped head positioned in said second slot and a shank portion extending upwardly through said third opening, said T-shaped head of said second clip bolt being prevented from upward vertical movement by said third pair of shoulders;

a second clip positioned on said second clip bolt and comprising an upper end portion having inner and outer ends, an inner end portion extending downwardly from the inner end of said upper end portion of said second clip for engagement with the base flange of an adjacent joint bar, an outer end portion extending downwardly from the outer end of said upper end portion, and a tooth means extending downwardly from the lower end of said outer end portion of said second clip into said second rectangular-shaped opening, said tooth means having a length substantially equal to the length of said second rectangular-shaped opening, said outer end portion having a width greater than said second rectangular-shaped opening to form a second heel portion in engagement with said tie plate rearward of said second rectangular-shaped opening;

said tooth means on said second clip being positioned outwardly of said T-shaped head portion of said second clip bolt to maintain said T-shaped head portion of said second clip bolt in said second slot and said shank portion in said third opening; and a nut means on the upper end of said second clip bolt for maintaining said second clip thereon.

2. In combination, a pair of railroad rails positioned in end-to-end relation and each having a base flange;

at least one joint bar extending between, securing and connecting said railroad rails in end-to-end relation;

each of said joint bars positioned adjacent a side of the joined rails and contacting said rails;

each of said joint bars having a base flange extending substantially parallel with and positioned above said base flange of said rails;

each of said joint bars having at least two openings formed therein substantially perpendicular to the longitudinal axis of said joint bar;

said rails having at least one opening formed therein substantially perpendicular to the longitudinal axes of said rails;

at least two securement devices extending through said openings in said joint bars and said rails whereby said joint bars may be secured to said rails;

an elongated cross-tie;

a tie plate having an upper surface, and a bottom surface positioned on said cross-tie;

said tie plate having a central recessed area formed in the upper surface thereof for receiving the base flange of a rail therein;

said recessed area being defined by a longitudinally extending first pair of shoulders on said tie plate, said tie plate having a gauge side positioned inwardly of said recessed area and a field side positioned outwardly of said recessed area;

said gauge-side and field-side tie plate shoulders each having an arcuate upper surface, forming a reversing fillet;

said tie plate having at least one opening formed therein adjacent each of the gauge and field sides thereof for receiving a fastening means extending downwardly therethrough into the cross-tie to secure said tie plate to the cross-tie;

said tie plate having a first generally rectangular-shaped opening formed herein extending downwardly therethrough between said recessed area and said gauge side, said first rectangular-shaped opening having its longitudinal axis parallel to the longitudinal axis of the rail;

said tie plate having a first slot formed beneath its upper surface which communicates with the lower portion of said first rectangular-shaped opening and which extends therefrom towards said recessed area;

said tie plate having a second opening formed therein extending downwardly therethrough, from the upper surface thereof, adjacent said recessed area which communicates with said first slot to define a second pair of shoulders therebetween;

a first clip bolt having a generally T-shaped head positioned in said first slot and a shank portion extending upwardly through said second opening, said T-shaped head being prevented from upward vertical movement by said second pair of shoulders, a first clip positioned on said first clip bolt and comprising an upper end portion having inner and outer ends, an outer end portion extending downwardly from the outer end of said upper end portion for engagement with the base flange of an adjacent joint bar, said outer end portion having a maximum width less than the distance between said openings in said joint bars, an inner end portion extending downwardly from the inner end of said upper end portion, and a tooth means extending downwardly from the lower end of said inner end portion of said first clip into said first rectangular-shaped opening, said tooth means having a length substantially equal to the length of said first rectangular-shaped opening, said outer end portion having a width greater than said first rectangular-shaped opening to form a first heel portion in engagement with said tie plate rearward of said first rectangular-shaped opening;

said tooth means being positioned inwardly of said T-shaped head portion of said first clip bolt to maintain said T-shaped head portion of said first clip bolt in said first slot and said shank portion in said second opening;

a nut means on the upper end of said first clip bolt for maintaining said first clip thereon;

said tie plate having a second generally rectangular-shaped opening extending downwardly therethrough between said recessed area and said field side, said second rectangular-shaped opening having its longitudinal axis parallel to the longitudinal axis of the rail;

said tie plate having a second slot formed beneath its upper surface which communicates with the lower portion of said second rectangular-shaped opening and which extends therefrom towards said recessed area;

said tie plate having a third opening formed therein extending downwardly therethrough, from the upper surface thereof which communicates with said second slot, to define a third pair of shoulders therebetween;

a second clip bolt having a generally T-shaped head positioned in said second slot and a shank portion extending upwardly through said third opening, said T-shaped head of said second clip bolt being prevented from upward vertical movement by said third pair of shoulders;

a second clip positioned on said second clip bolt and comprising an upper end portion having inner and outer ends, an inner end portion extending downwardly from the inner end of said upper end portion of said second clip for engagement with the base flange of an adjacent joint bar, said inner end portion having a maximum width less than the distance between said openings in said joint bars, an outer end portion extending downwardly from the outer end of said upper end portion, and a tooth means extending downwardly from the lower end of said outer end portion of said second clip into said second rectangular-shaped opening, said tooth means having a length substantially equal to the length of said second rectangular-shaped opening said outer end portion having a width greater than said second rectangular-shaped opening to form a second heel portion in engagement with said tie plate rearward of said second rectangular-shaped opening;

said tooth means on said second clip being positioned outwardly of said T-shaped head portion of said second clip bolt to maintain said T-shaped head portion of said second clip bolt in said second slot and said shank portion in said third opening; and a nut means on the upper end of said second clip bolt for maintaining said second clip thereon.

3. The system of claim 2 wherein said joint bar comprises an elongated member having a generally I-shaped cross-section having top and bottom extensions, said bottom extension extending substantially parallel to said base flange of said rail.

4. The system of claim 3 wherein said first and second clips engage said joint bars on an upper surface of said bottom extensions of said joint bars.

* * * * *